US008048824B2

(12) United States Patent
Navazo et al.

(10) Patent No.: US 8,048,824 B2
(45) Date of Patent: Nov. 1, 2011

(54) SYSTEMS AND METHODS FOR PRINTING BORDERLESS IMAGES ON PRINTABLE MEDIA

(75) Inventors: Juan Manuel Valero Navazo, Sant Cugat del Valles (ES); David Claramunt Morera, Sant Cugat del Valles (ES); Pasqual Batalia, Sant Cugat del Valles (ES); Ezequiel Jordi Rufes Bernad, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1255 days.

(21) Appl. No.: 11/726,063

(22) Filed: Mar. 20, 2007

(65) Prior Publication Data

US 2008/0234127 A1 Sep. 25, 2008

(51) Int. Cl.
*B41M 5/20* (2006.01)

(52) U.S. Cl. ..... 503/201

(58) Field of Classification Search ..... None
See application file for complete search history.

(56) References Cited

U.S. PATENT DOCUMENTS

| | | | | |
|---|---|---|---|---|
| 3,691,140 | A | 9/1972 | Silver | |
| 4,457,539 | A * | 7/1984 | Hamisch, Jr. | 283/87 |
| 5,683,194 | A | 11/1997 | Emmel et al. | |
| 5,782,494 | A | 7/1998 | Crandall et al. | |
| 5,951,054 | A * | 9/1999 | Hagen et al. | 283/81 |
| 6,137,515 | A * | 10/2000 | Dickinson | 347/101 |
| 6,153,278 | A | 11/2000 | Timmerman et al. | |
| 6,669,992 | B2 | 12/2003 | Le Riche | |
| 6,756,100 | B2 | 6/2004 | Pearson et al. | |
| 6,773,539 | B2 | 8/2004 | Mertens et al. | |
| 6,905,763 | B2 | 6/2005 | Crandall et al. | |
| 6,910,667 | B2 | 6/2005 | O'Leary et al. | |
| 2005/0174416 | A1 * | 8/2005 | Looman et al. | 347/105 |

OTHER PUBLICATIONS

3M® Company Post-it® Flag, < http://www.post-it.com/wps/portal/3M/en_US/Post_It/Global/?WT.mc_id=www.3m.com/us/office/postit/ > or < http://www.post-it.com >.*

3M® Company Post-it® Flag writing tools, < http://www.post-it.com/wps/portal/3M/en_US/Post_It/Global/?WT.mc_id=www.3m.com/us/office/postit/ > or to: < http://www.post-it.com >.*

* cited by examiner

*Primary Examiner* — Stephen D Meier
*Assistant Examiner* — Alexander C Witkowski

(57) ABSTRACT

A system of printing borderless images on printable media includes at least one sheet of printable media including an imaging surface and a non-imaging surface. The system further includes a removable extension strip having a front surface with an adhesive zone and a non-adhesive zone, a non-adhesive back surface, and a straight line of demarkation between the adhesive and non-adhesive zones. The adhesive zone is configured to removably adhere to the non-imaging surface, and the straight line of demarkation is configured as a placement guide for adhering the adhesive zone of the extension strip to the media. An associated method includes adhering an adhesive portion of removable extension strip to a non-imaging surface proximate a trailing edge of the media, and ink-jet printing an image on an imaging surface of the media using an ink-jet printer. The strip is used by rollers in the printer to advance the media.

22 Claims, 1 Drawing Sheet

SYSTEMS AND METHODS FOR PRINTING BORDERLESS IMAGES ON PRINTABLE MEDIA

BACKGROUND OF THE INVENTION

Many consumers desire to print images such as photographs on single sheet, printable media without any margins or borders around the image. A typical problem when printing borderless images on single sheets is that image quality can be affected near the trailing edge of the printable media. A reduction in image quality near the trailing edge of the printable media can be the result of the feeding systems that ink-jet printers use to advance the media through the printer.

Specifically, ink-jet printers typically use a primary roller to advance media through the printer. The primary roller is positioned with respect to the printing portion of the printer so that the media is touched by the primary roller before the media is printed. To print a borderless image on printable media, the printable media is typically released from the primary roller and a secondary roller or feeder advances the printable media while the area adjacent the trailing edge of the media is printed. The transition between the primary roller and the secondary feeder often generates poor or reduced image quality near the trailing edge of the media because of advancing errors and changes in the position of the media with respect to the printing part of the printer. This reduction in image quality near the trialing edge of printable media is often referred to as a Bottom of Form Transition Error.

Double overdrive advancing systems have been developed to allow consumers to print borderless images on printable media. To print the trailing edge of printable media using these systems, the media is released from a pincher or nip between a driver roller and a pinch roller. Thereafter, the last part of the media is advanced using the overdrive advance system.

While relatively simple to use, such double overdrive systems have proved disadvantageous in that advance calibration parameters are often different from one advance feeding system to the other in a single printer. Typically, the advance ratio in the overdrive is higher than the advance ratio in the primary advance system for purposes of pulling the media in the print zone. Moreover, sensing of the transition point between the primary advance system and the overdrive system is not perfectly accurate, and thus the different calibration parameters are not changed at exactly the right moment. Additionally, when advanced by the primary roller, media is pressed against the print plate with a specific entry angle that enables control of the media. However, when the media is released from the pinchers of the primary advance system, the angle changes, the bending force resulting from the angle is released, and the media is pushed forward in the print zone.

Another disadvantage is that many overdrive systems do not have good traction, and thus, do not firmly feed the media at a continuous rate through the printer. This results in media advance errors near the trailing edge of the printed media. Also, if the printable media has upcurl when released from the pinchers, there is nothing in the printer that pushes the media downward. This can lead to a head crash of the pen head with the border of the media. Even if upon release from the pinchers, upcurl in the media is low, and head crash does not occur, image quality may still be affected due to the variations in the advance calibration parameters between the primary advance and overdrive systems.

DETAILED DESCRIPTION OF THE PREFERRED EMBODIMENT(S)

Figure 1:
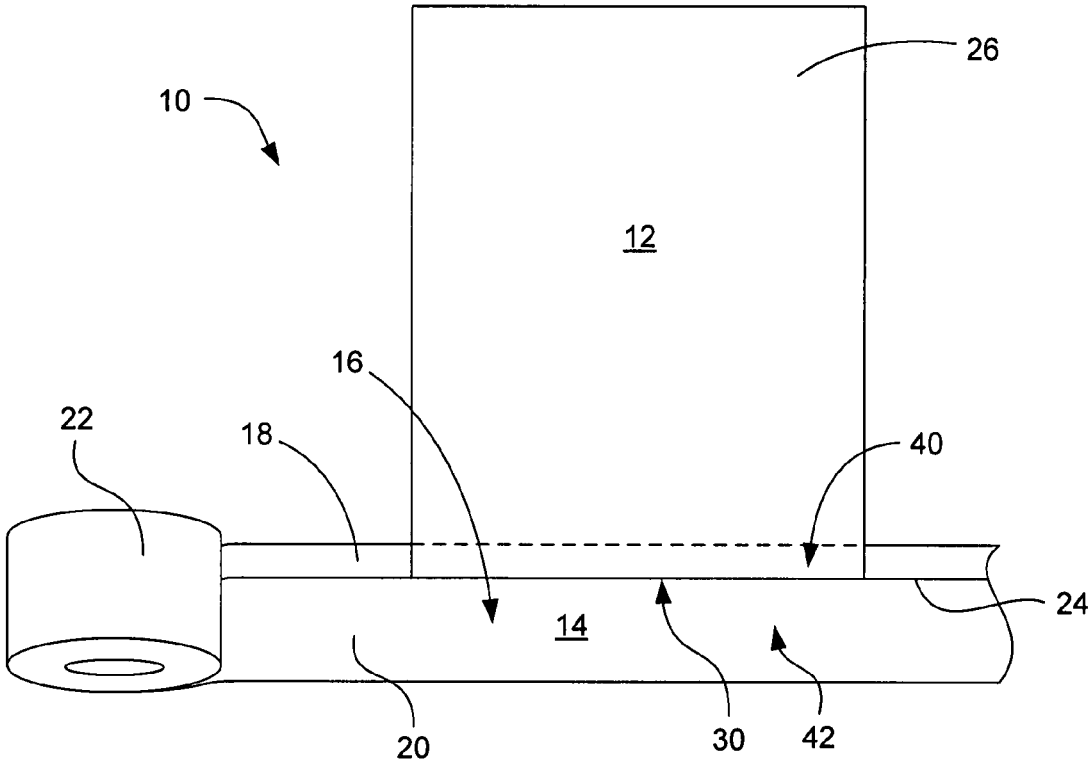
FIG. 1 is a perspective view of a system of printing borderless images on printable media in accordance with an embodiment of the present invention.

Before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used:

The singular forms "a," "an," and "the" include plural referents unless the context clearly dictates otherwise.

As used herein, the term "image" is to be understood to refer to an image applied by a printer that can include a variety of printed material including textual material, pictorial material, iconographical material, etc., and various combinations thereof. A printed image can be applied using any of a number of known printing methods, without limitation. In one embodiment, the printed image can be applied using a printing device, such as an ink-jet printer.

As used herein, the terms "removable," or "removably attached," are to be understood to refer to an attached relationship between two materials in which the materials remain attached under a first set of conditions but can be unattached from each other without causing significant structural damage to either of the materials and without transferring significant residue from one of the materials to the other.

As used herein, the term "imaging surface" refers to a surface of a sheet of media on which images are currently being printed. The term "non-imaging surface" refers to the surface of a sheet of media on which images are not currently being printed. A non-imaging surface can be capable of having images printed thereon; however, images are not currently being printed thereon in accordance with embodiments of the present invention. For example, photographs are printed on the imaging surface of photograph paper, while the non-imaging surface is traditionally left blank. The non-imaging surface of the printable media can be of the same coating or composition as the imaging surface, as is the case for digital fine arts media, which is printable on both sides thereof. The imaging surface of photo media, however, typically includes a different coating or composition than the non-imaging surface.

As used herein, the term "full bleed plot" refers to a printed image that covers the entire imaging surface of a sheet of media. A full bleed plot does not have blank margins or any blank areas on the imaging surface of a sheet of media. Borderless photo imaging is an example of full bleed plot imaging.

As used herein, the term "printable media" refers to any media on which an image may be printed.

As used herein, the term "large format media" refers to any printable media being printed upon using a large format printer. For example, large format sheet sizes can be utilized in the present invention having lengths ranging from 10 to 100 inches on their shortest sides.

With these definitions in mind, the present invention is drawn to a system of printing borderless images on printable media. The system can comprise at least one sheet of printable media including an imaging surface and a non-imaging surface, and a removable extension strip. The removable extension strip can comprise a front surface including an adhesive zone and a non-adhesive zone, a non-adhesive back surface, and a straight line of demarkation between the adhesive zone and the non-adhesive zone. The adhesive zone can be configured to removably adhere to the non-imaging surface, and the straight line of demarkation can be configured as a placement guide for adhering the adhesive zone of the removable extension strip to the printable media.

In another embodiment, a method of printing a borderless image on printable media can comprise adhering a first portion of a removable extension strip to a non-imaging surface proximate a trailing edge of the printable media, wherein a second portion of the removable extension strip extends beyond the trailing edge. An additional step includes ink-jet printing an image on an imaging surface of the printable media using an ink-jet printer, wherein the removable extension strip is used by rollers of the printer to advance the media through the printer.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. Further, it is noted that the FIGS. are not necessarily drawn to scale, but rather, are drawn to more clearly show embodiments of the present invention. For example, the printable media may be drawn smaller or larger with respect to the removable extension strip for a given application.

Figure 2:
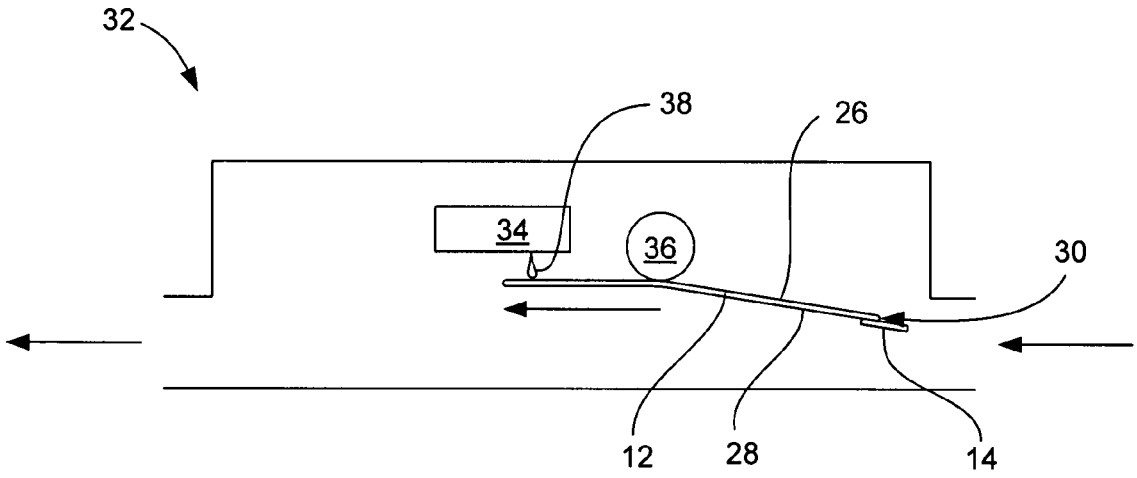
FIG. 2 is a schematic side view of the system of the present invention, as shown in accordance with their relationship with some components of an ink-jet printer.

As illustrated in FIGS. 1 and 2, a system 10 of printing borderless images on printable media 12 in accordance with the present invention is shown that provides at least one sheet of printable media including an imaging surface 26 and a non-imaging surface (not shown in FIG. 1). The system also includes a removable extension strip 14. The removable extension strip includes a front surface 16 having an adhesive zone 18 and a non-adhesive zone 20, and a non-adhesive back surface 22. The removable extension strip also includes a straight line of demarkation 24 between the adhesive zone and the non-adhesive zone. The adhesive zone is configured to removably adhere to the non-imaging surface of the printable media, and the straight line of demarkation is configured as a placement guide for adhering the adhesive zone of the removable extension strip to the printable media.

The sheet of printable media 12 may be any sheet size. For example, the printable media may include standard sheet sizes such as 8½×11 inch media or A4 media. The printable media may also be large format media, such as 18×24 inch media, A1 media (approximately 23.4×33.1 inches), A2 media (approximately 16.5×23.4 inches), A3 media (approximately 11.7×16.5 inches), and B+ media (approximately 13.9×19 inches). Additionally, even larger sheet sizes can be utilized in the present invention such as sheets having lengths of 24 inches, 36 inches, 42 inches, or larger on their shortest sides.

The removable extension strip 14 can be made out of a variety of relatively thin film materials including, but not limited to, plastic, vinyl, cellophane, paper, or the like. In one embodiment, the removable extension strip comprises paper. The adhesive zone 18 is configured to removably adhere to the non-imaging surface (not shown in FIG. 1) of the printable media 12. In another embodiment, the materials comprising the removable extension strip are configured to act as a substrate for ink and/or lead so that a user can make notations and enter data and information on the removable extension strip with markers, pens, pencils and other known writing utensils.

With regard to the shape of the removable extension strip 14, it may be in the shape of an individual sheet cut to a predetermined size that corresponds directly with the specific length of the trailing edge 30 of the sheet of printable media 12. For example, the removable extension strip may be precut to a length of 24 inches to correspond to a sheet of printable media that is 24 inches along its shortest edge. In one embodiment, the removable extension strip is in a roll, e.g., rolled in a fashion similar to that of rolled adhesive tape. Generally, in this embodiment, the removable extension strip is longer than a trailing edge of the printable media. In this case, the length of the extension strip can be shortened so as to substantially correspond with a length of the trailing edge of the sheet of printable media. The length of the extension strip can be shortened by cutting, tearing or ripping the removable extension strip. In one embodiment, the removable extension strip may have intermittent perforations (not shown) perpendicular to a horizontal axis of the removable extension strip. Such perforations enable a user to easily tear the strip to a desired length that corresponds with the length of the trailing edge of the sheet of printable media.

As mentioned, the removable extension strip 14 can also include a straight line of demarkation 24 between the adhesive zone 18 and the non-adhesive zone 20. The straight line of demarkation is configured as a placement guide for adhering the adhesive zone of the removable extension strip to the printable media 12. In one embodiment, the line of demarkation is printed on the front surface 16 of the removable extension strip 14. In another embodiment, the adhesive zone is a first color and the non-adhesive zone is a second color. In this embodiment, the line of demarkation is provided by an interface of the first and second colors.

The adhesive zone 18 on the front surface of the removable extension strip typically comprises a low tack, pressure sensitive adhesive that is capable of securing the adhesive zone to the sheet of printable media 12, but is also capable of being easily removed from the sheet of printable media without causing structural damage or tearing either the sheet of printable media or the removable extension strip. In one embodiment, the adhesive zone includes an adhesive that does not leave any residue on the printable media once the removable extension strip is removed after use.

The adhesive zone can comprise, for example, acrylate copolymers including at least one alkyl acrylate ester and at least one monomer that may be substantially oil insoluble, substantially water soluble, and/or ionic. Maleic anhydride is an example of a monomer that can be copolymerized therewith. These and other types of copolymers can enable bonding of the adhesive zone 18 on the extension strip 14 to the sheet of printable media 12. These types of copolymers can also be configured to enable simple removal of the extension strip from the sheet of printable media without causing structural damage or tearing either the extension strip or the printable media during removal of the extension strip. Additionally, the copolymers do not leave adhesive residue on the printable media after the extension strip is removed. The copolymers are also configured to permit subsequent re-bonding of the extension strip without applying additional adhesive to the adhesive zone. In one aspect, a single removable extension strip can be used for multiple applications.

In addition to the structural elements provided by the present invention and discussed above, the present invention also provides a method of printing a borderless image on printable media 12. The method comprises adhering a first portion 40 of a removable extension strip 14 to a non-imaging surface 28 proximate a trailing edge 30 of the printable media, wherein a second portion 42 of the removable extension strip extends beyond the trailing edge. The method also comprises inkjet printing 38 an image (not shown), using ink-jet printing architecture 34, on an imaging surface 26 of the printable media using an ink-jet printer 32, wherein the removable extension strip is used by rollers 36 of the printer to advance the media through the printer.

In one embodiment, the printable media 12 includes a coated substrate suitable for photographic quality printing. For example, the printable media can include a media substrate coated with an ink-receiving layer. The coated substrate may include an inorganic porous particulate-based coating. In another embodiment the coated substrate includes a polymeric swellable coating. The substrate can be paper, plastic, coated paper, fabric, art paper, or other known substrate used in the ink-jet printing arts. In one embodiment, photobase can be used as the substrate. Photobase is typically a three-layered system comprising a single layer of paper sandwiched by two polymeric layers, such as polyethylene layers.

If a porous ink receiving layer is used, inorganic semi-metal or metal oxide particulates, a polymeric binder, and optionally, mordants and/or other porous coating composition agents can be present. In one embodiment, the inorganic semi-metal or metal oxide particulates can be silica, alumina, boehmite, silicates (such as aluminum silicate, magnesium silicate, and the like), titania, zirconia, calcium carbonate, clays, and combinations thereof. In order to bind the inorganic particulates together in the porous coating composition, a polymeric binder is typically included. Exemplary polymeric binders that can be used include polyvinyl alcohol including water-soluble copolymers thereof; polyvinyl acetate; polyvinyl pyrrolidone; modified starches including oxidized and etherified starches; water soluble cellulose derivatives including carboxymethyl cellulose, hydroxyethyl cellulose; polyacrylamide including its derivatives and copolymers; casein; gelatin; soybean protein; silyl-modified polyvinyl alcohol; conjugated diene copolymer latexes including maleic anhydride resin, styrene-butadiene copolymer, and the like; acrylic polymer latexes including polymers and copolymers of acrylic and methacrylic acids, and the like; vinyl polymer latexes including ethylene-vinyl acetate copolymers; functional group-modified latexes including those obtained by modifying the above-mentioned polymers with monomers containing functional groups (e.g. carboxyl, amino, amido, sulfo, etc.); aqueous binders of thermosetting resins including melamine resins, urea resin, and the like; synthetic resin binders including polymethyl methacrylate, polyurethane resin, polyester resin, amide resin, vinyl chloride-vinyl acetate copolymer, polyvinyl butyral, and alkyl resins.

Alternatively, the ink receiving layer can be a polymeric swellable coating which can be hydrophilic. Suitable swellable polymers include gelatin, polyvinyl alcohol, methyl cellulose, polyvinyl pyrolidone, polyethylene oxide, or combinations thereof. In this embodiment, when the ink is printed on the swellable polymeric coating, the ink is soaked into the polymeric matrix and entraps the ink therein.

Other coating systems can also or alternatively be used, as are known in the art.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A system of printing borderless images on printable media, comprising:

a) at least one sheet of printable media including an imaging surface and a non-imaging surface; and b) a removable extension strip, comprising:

a front surface including an adhesive zone and a non-adhesive zone;

a non-adhesive back surface; and a straight line of demarkation between the adhesive zone and the non-adhesive zone, wherein the adhesive zone is configured to removably adhere to the non-imaging surface, and wherein the straight line of demarkation is configured as a placement guide for adhering the adhesive zone of the removable extension strip to the printable media.

2. The system of claim 1, wherein the removable extension strip is longer than a trailing edge of the printable media, wherein a length of the extension strip can be shortened so as to substantially correspond with a length of the trailing edge of the printable media.

3. The system of claim 1, wherein the line of demarkation is printed on the front surface of the removable extension strip.

4. The system of claim 1, wherein the removable extension strip comprises paper.

5. The system of claim 1, wherein the adhesive zone is a first color and the non-adhesive zone is a second color, and wherein the line of demarkation is provided by an interface of the first and second colors.

6. The system of claim 1, wherein the printable media includes a coated substrate suitable for photographic quality printing.

7. The system of claim 6, wherein the coated substrate includes an inorganic porous particulate-based coating.

8. The system of claim 6, wherein the coated substrate includes a polymeric swellable coating.

9. The system of claim 1, wherein the adhesive zone includes an adhesive that does not leave any residue on the printable media once the removable extension strip is removed from the printable media after use.

10. The system of claim 1, wherein the printable media is large format media.

11. A method of printing a borderless image on printable media, comprising:

a) adhering a first portion of a removable extension strip to a non-imaging surface proximate a trailing edge of the printable media, wherein a second portion of the removable extension strip extends beyond the trailing edge; and b) ink-jet printing an image on an imaging surface of the printable media using an ink-jet printer, wherein the removable extension strip is used by rollers of the printer to advance the media through the printer.

12. The method of claim 11, further comprising shortening the length of the extension strip to substantially correspond with the length of the trailing edge of the printable media.

13. The method of claim 11, further comprising removing the removable extension strip from the non-imaging surface of the printable media after the ink-jet printing.

14. The method of claim 13, wherein substantially no residual adhesive remains on the printable media once the removable extension strip is removed after use.

15. The method of claim 11, wherein the removable extension strip includes a straight line of demarkation between the first portion and the second portion of the removable extension strip, and wherein the method of printing a borderless image on printable media further comprises aligning the line of demarkation with the trailing edge of the printable media so that only the first portion of the extension strip interfaces with the non-imaging surface of the printable media.

16. The method of claim 11, wherein the first portion of the extension strip is a first color and the second portion of the extension strip is a second color, and a line of demarkation is provided by an interface of the first and second colors.

17. The method of claim 11, wherein the removable extension strip comprises paper.

18. The method of claim 11, wherein the printable media is at least 24 inches along its shortest edge.

19. The method of claim 11, wherein the printable media includes a coated substrate suitable for photographic quality printing.

20. The method of claim 19, wherein the coated substrate includes an inorganic porous particulate-based coating.

21. The method of claim 19, wherein the coated substrate includes a polymeric swellable coating.

22. The method of claim 11, wherein the printable media is large format media.

* * * * *